US007568582B1

(12) United States Patent
Berger

(10) Patent No.: US 7,568,582 B1
(45) Date of Patent: Aug. 4, 2009

(54) MEDICINE CADDY

(76) Inventor: Stuart Berger, 141 Halstead Ave., Mamaroneck, NY (US) 10543

( * ) Notice: Subject to any disclaimer, the term of this patent is extended or adjusted under 35 U.S.C. 154(b) by 734 days.

(21) Appl. No.: 11/314,425

(22) Filed: Dec. 21, 2005

(51) Int. Cl.
*A47B 73/00* (2006.01)
*A47B 47/06* (2006.01)
*A47B 57/58* (2006.01)

(52) U.S. Cl. ..... 211/74; 108/60; 108/101

(58) Field of Classification Search ..... 206/371, 206/427, 429, 431, 828, 139, 141; 211/74; 108/27, 60, 91, 93, 101, 180; D6/460, 461
See application file for complete search history.

(56) References Cited

U.S. PATENT DOCUMENTS

| | | | | | |
|---|---|---|---|---|---|
| 1,598,849 | A | * | 9/1926 | Colby | 108/25 |
| 1,787,347 | A | * | 12/1930 | Wellemeyer | 141/98 |
| 2,127,722 | A | * | 8/1938 | Erickson | 108/25 |
| 2,404,532 | A | * | 7/1946 | Rocker | 206/435 |
| 2,510,591 | A | * | 6/1950 | Listman | 206/199 |
| 2,597,407 | A | * | 5/1952 | Thompson | 422/303 |
| 2,626,059 | A | * | 1/1953 | Turner | 211/44 |
| 2,908,400 | A | * | 10/1959 | Richter | 108/60 |
| 3,039,651 | A | * | 6/1962 | Lang | 206/172 |
| 3,095,085 | A | | 6/1963 | Meijer | |
| 3,209,709 | A | * | 10/1965 | Shoffner | 108/27 |
| 3,394,796 | A | | 7/1968 | Jensen | |
| 3,966,103 | A | * | 6/1976 | Abrams | 294/144 |
| 4,026,220 | A | * | 5/1977 | Schuring, Jr. | 108/101 |
| 4,127,190 | A | | 11/1978 | Sunnen | |
| 4,144,662 | A | | 3/1979 | Drexler | |
| 4,381,059 | A | | 4/1983 | Schurman | |
| 4,432,306 | A | | 2/1984 | Lyss | |
| 4,572,403 | A | | 2/1986 | Benaroya | |
| 4,621,746 | A | | 11/1986 | Reichle et al. | |
| 4,986,416 | A | * | 1/1991 | Arthurs | 206/170 |
| 5,078,282 | A | * | 1/1992 | Stanfield | 211/74 |
| 5,141,117 | A | * | 8/1992 | Olsen et al. | 211/71.01 |
| 5,823,363 | A | * | 10/1998 | Cassel | 211/60.1 |
| 6,068,158 | A | | 5/2000 | Chabout | |
| 6,439,406 | B1 | | 8/2002 | Duhon | |
| 6,755,310 | B1 | | 6/2004 | Hilton et al. | |
| 6,971,518 | B1 | * | 12/2005 | Lowry | 206/386 |
| 2003/0034317 | A1 | * | 2/2003 | Lafond et al. | 211/74 |
| 2005/0035009 | A1 | * | 2/2005 | Cuomo | 206/162 |

* cited by examiner

*Primary Examiner*—Michael Safavi

(57) ABSTRACT

Medicine caddies store and organize medicines. A bottom tier with a first shelf, a first wall, and a first divider is slidably and rotatably mounted on a base. A second tier with a second shelf, a second wall, and a second divider is attached to the first wall. Barriers enclose the sides of the first and second walls. Cutouts present in the middle of the first and second walls allow divider hooks on the dividers to be slidably and removably attached to the first and second walls. Barrier slots in the top of the barriers slidably and removably receive barrier hooks attached to the dividers. A second embodiment has a rotation joint between the first and second walls and has its dividers slidably attached to only the first and second walls. Tabs are provided as a perforated sheet and are attached to the barriers by tab holders to identify medicines.

15 Claims, 5 Drawing Sheets

MEDICINE CADDY

BACKGROUND OF THE INVENTION

1. Field of the Invention

The present invention relates to a medicine caddy for use in connection with organizing items. The medicine caddy has particular utility in connection with storing and organizing medicines.

2. Description of the Prior Art

Medicine caddies are desirable for storing and organizing medicines. Many people, particularly the elderly, are required to take multiple medications. Organizing and storing medications can be challenging, and it is important that the patient takes the correct medication. A variety of medication dispensers are known that address this problem.

The use of can dispensers is known in the prior art. For example, U.S. Pat. No. 6,755,310 to Hilton et al. discloses a can dispenser. However, the Hilton et al. '310 patent does not have adjustable dividers, and has further drawbacks of lacking adjustable tab holders and custom tabs.

U.S. Pat. No. 6,439,406 to Duhon discloses a carousel device for storing medication containers that stores medication containers. However, the Duhon '406 patent does not have a magnifying glass, and additionally does not have adjustable tab holders and custom tabs.

Similarly, U.S. Pat. No. 6,068,158 to Chabout discloses a pill distributor that distributes pills. However, the Chabout '158 patent does not have adjustable dividers, cannot hold medicine bottles, and omits adjustable tab holders and custom tabs.

In addition, U.S. Pat. No. 4,621,746 to Reichle et al. discloses a vending apparatus that dispenses items. However, the Reichle et al. '746 patent does not have adjustable dividers, does not have adjustable tab holders and custom tabs, and also does not have a magnifying glass.

Furthermore, U.S. Pat. No. 4,572,403 to Benaroya discloses a time dispensing device for tablets, capsules, and the like that dispenses medications. However, the Benaroya '403 patent does not have adjustable dividers, omits adjustable tab holders and custom tabs, and further lacks the ability to hold medicine bottles.

U.S. Pat. No. 4,432,300 to Lyss discloses a pill dispenser with sequential dispensing and indicating cap that dispenses pills. However, the Lyss '300 patent does not have adjustable dividers, omits adjustable tab holders and custom tabs, and has the additional deficiency of not holding medicine bottles.

In addition, U.S. Pat. No. 4,381,059 to Schurman discloses a puzzle-locking container and method for storing and dispensing articles that stores and dispenses articles. However, the Schurman '059 patent does not have adjustable dividers, omits adjustable tab holders and custom tabs, and also does not hold medicine bottles.

Furthermore, U.S. Pat. No. 4,144,662 to Drexler discloses a display and dispenser that displays and dispenses items. However, the Drexler '662 patent does not have adjustable dividers, omits adjustable tab holders, and further lacks a magnifying glass.

Similarly, U.S. Pat. No. 4,127,190 to Sunnen. discloses a dispenser for dispensing pills or tablets in a predetermined order that dispenses pills or tablets in a predetermined order. However, the Sunnen. '190 patent does not have adjustable dividers, omits adjustable tab holders and custom tabs, and has the additional deficiency of not holding medicine bottles.

Furthermore, U.S. Pat. No. 3,394,796 to Jensen discloses a pill dispenser that dispenses pills. However, the Jensen '796 patent does not have adjustable dividers, omits adjustable tab holders and custom tabs, and has the additional deficiency of not holding medicine bottles.

Lastly, U.S. Pat. No. 3,095,085 to Meijer discloses pocket containers for the selective dispensing of tablets that selectively dispenses tablets. However, the Meijer '085 patent does not have adjustable dividers, omits adjustable tab holders and custom tabs, and has the additional deficiency of not holding medicine bottles.

While the above-described devices fulfill their respective, particular objectives and requirements, the aforementioned patents do not describe a medicine caddy that allows storing and organizing medicines.

Therefore, a need exists for a new and improved medicine caddy that can be used for storing and organizing medicines. In this regard, the present invention substantially fulfills this need. In this respect, the medicine caddy according to the present invention substantially departs from the conventional concepts and designs of the prior art, and in doing so provides an apparatus primarily developed for the purpose of storing and organizing medicines.

SUMMARY OF THE INVENTION

In view of the foregoing disadvantages inherent in the known types of can dispensers now present in the prior art, the present invention provides an improved medicine caddy, and overcomes the above-mentioned disadvantages and drawbacks of the prior art. As such, the general purpose of the present invention, which will be described subsequently in greater detail, is to provide a new and improved medicine caddy which has all the advantages of the prior art mentioned heretofore and many novel features that result in a medicine caddy which is not anticipated, rendered obvious, suggested, or even implied by the prior art, either alone or in any combination thereof.

To attain this, the present invention essentially comprises a base with a first shelf attached to its top. A first wall is perpendicularly attached to the first shelf's top. A second wall is attached to the first wall, and a second shelf is perpendicularly attached to the second wall. A first barrier has its opposing sides attached to the opposing sides of the first wall, and a second barrier has its opposing sides attached to the opposing sides of the second wall. A first divider has one of the opposing sides of its top removably and slidably connected to the first wall and the other side of its top removably and slidably connected to the first barrier. A second divider has one of the opposing sides of its top removably and slidably connected to the second wall and the other side of its top removably and slidably connected to the second barrier.

There has thus been outlined, rather broadly, the more important features of the invention in order that the detailed description thereof that follows may be better understood and in order that the present contribution to the art may be better appreciated.

The invention may also include a first cutout in the middle of the first wall and a second cutout in the middle of the second wall. There may be a first divider wall hook attached to one of the opposing sides of the top of the first divider and a second divider wall hook attached to one of the opposing sides of the top of the second divider. There may be a first barrier slot in the top of the first barrier and a second barrier slot in the top of the second barrier. There may be a first divider hook attached to the other side of the top of the first divider and a second divider barrier hook attached to the other side of the top of the second divider. There may be a tab holder removably attached to the first barrier or the second barrier.

There may be a thumb tab in one of the opposing sides of the first wall and an emergency contact card slidably and removably inserted into the thumb tab. There may be a magnifying lens slidably and removably inserted into the thumb tab. There may be a thumb tab in both sides of the first wall. There may be a base slot in the top of the base that permits the first shelf to slide and rotate with respect to the base. The tab holder may be translucent or transparent. There may be a plurality of tabs joined by perforations into a perforated sheet. The tabs may be red, blue, yellow, or green. There may be a rotation joint rotatably connecting the first wall to the second wall. The base may be about 11 inches long and 9 inches wide. The second shelf may be about 9.5 inches long and 7.75 inches wide. The medicine caddy may be made of plastic, steel, aluminum, titanium, glass, or carbon fiber composite. The first divider wall hook may be removably inserted into the first cutout and the second divider wall hook may be removably inserted into the second cutout. The first divider barrier hook may be removably inserted into the first barrier slot and the second divider barrier hook may be removably inserted into the second barrier slot. The tabs in the perforated sheet may be separated from one another and removably attached to the first barrier and/or the second barrier by being removably inserted into the tab holders attached to the first barrier and/or the second barrier. The first barrier may have its bottom attached to the top of the first shelf. The second barrier may have its bottom attached to the top of the second shelf. The first divider may be slidably connected to only the first wall and the second divider may be slidably connected to only the second wall. There may be a first wall slot and a second wall slot in the first wall and second wall, respectively. The first shelf and the second shelf may be round. There may be a first shelf thumb tab, and the first shelf may rotate with respect to the base. There are, of course, additional features of the invention that will be described hereinafter and which will form the subject matter of the claims attached.

Numerous objects, features, and advantages of the present invention will be readily apparent to those of ordinary skill in the art upon a reading of the following detailed description of presently current, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved medicine caddy that has all of the advantages of the prior art can dispensers and none of the disadvantages.

It is another object of the present invention to provide a new and improved medicine caddy that may be easily and efficiently manufactured and marketed.

An even further object of the present invention is to provide a new and improved medicine caddy that has a low cost of manufacture with regard to both materials and labor, and which accordingly is then susceptible of low prices of sale to the consuming public, thereby making such medicine caddy economically available to the buying public.

Still another object of the present invention is to provide a new medicine caddy that provides in the apparatuses and methods of the prior art some of the advantages thereof, while simultaneously overcoming some of the disadvantages normally associated therewith.

Even still another object of the present invention is to provide a medicine caddy for storing and organizing medicines. This allows the user to customize the quantity and position of the dividers.

Still yet another object of the present invention is to provide a medicine caddy for storing and organizing medicines. This makes it possible to easily locate a particular medication.

An additional object of the present invention is to provide a medicine caddy for storing and organizing medicines. This allows the top tier to rotate independently of the bottom tier.

A further object of the present invention is to provide a medicine caddy for storing and organizing medicines. This allows the bottom tier to slide and rotate with respect to the base.

Lastly, it is an object of the present invention to provide a new and improved medicine caddy for storing and organizing medicines.

These together with other objects of the invention, along with the various features of novelty that characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there is illustrated current embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE CURRENT EMBODIMENT

Figure 1:
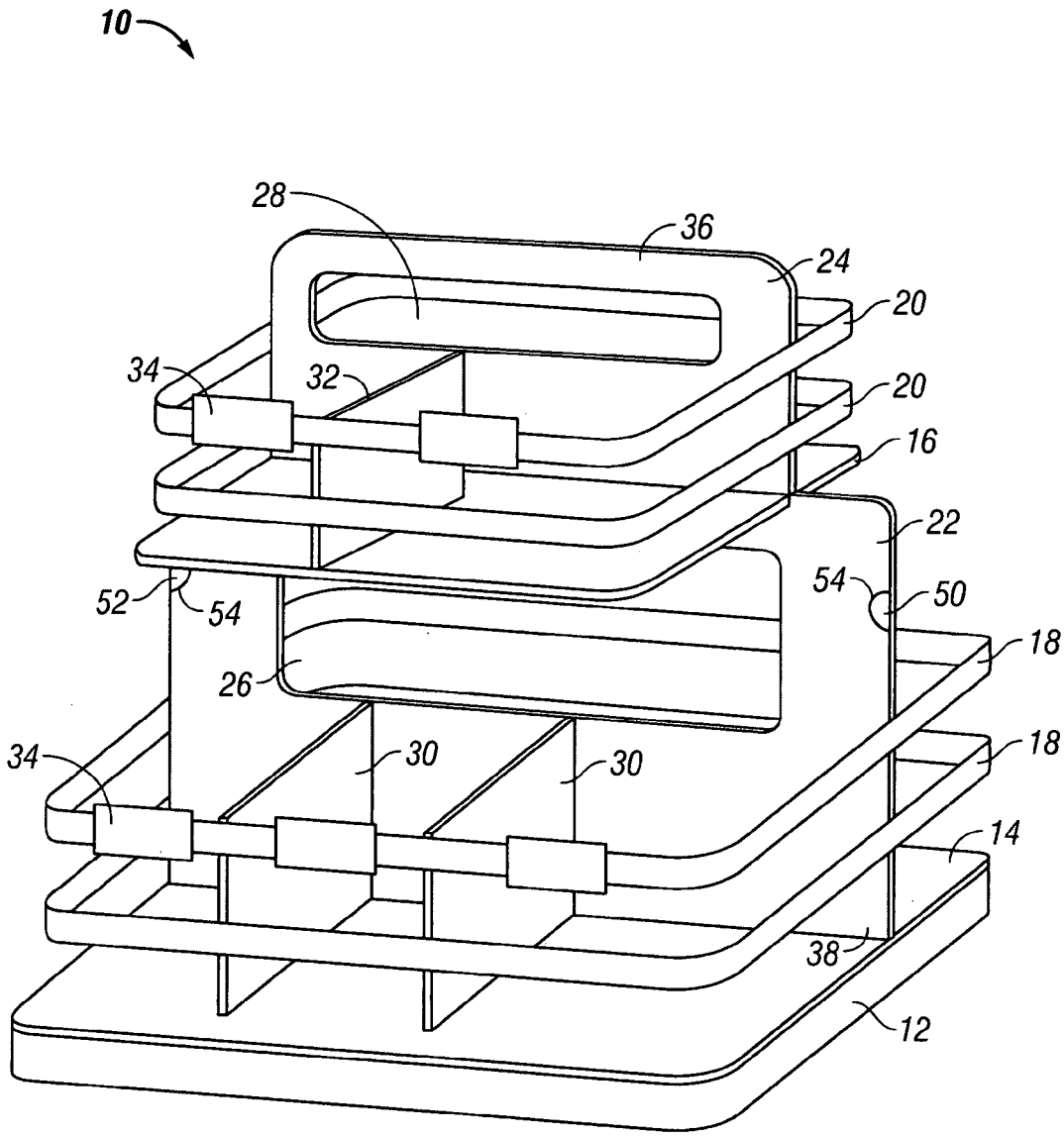
FIG. 1 is a top perspective view of the current embodiment of the medicine caddy constructed in accordance with the principles of the present invention.

Referring now to the drawings, and particularly to FIGS. 1-8, a current embodiment of the medicine caddy of the present invention is shown and generally designated by the reference numeral 10.

In FIG. 1, a new and improved medicine caddy 10 of the present invention for storing and organizing medicines is illustrated and will be described. More particularly, the medicine caddy 10 has base 12, upon which are mounted bottom tier 38 and top tier 36. Bottom tier 38 consists of first shelf 14, onto which first wall 22 is mounted perpendicularly. First barriers 18 are attached by their sides to the side edges of first wall 22. Tab holders 34 are depicted attached to the uppermost of first barriers 18, but can also be attached to the lower first barrier 18. Tab holders 34 may be clipped or snapped on to first barriers 18. The upper portion of first wall 22 has first cutout 26 in it. First dividers 30 are arranged perpendicularly to both first shelf 14 and first wall 22. First dividers 30 extend between first barriers 18 and first cutout 26 and are slidably mounted on first wall 22 and the uppermost first barrier 18. Emergency contact card 50 is accessible via thumb tab 54 in one side of first wall 22, and magnifying lens 52 is accessible through another thumb tab 54 in the other side of first wall 22. Alternatively, magnifying lens 52 may be located in base 12, or may be omitted altogether. Emergency contact card 50 conveniently provides emergency phone numbers in the event of an emergency. Magnifying lens 52 facilitates locating and dispensing medication for users with poor eyesight. In the current embodiment, base 12 is about 9 inches wide and 11 inches long. Top tier 36 consists of second shelf 16 onto which second wall 24 is mounted perpendicularly. Second shelf 16 is attached to the top of first wall 22. Second barriers 20 are attached by their sides to the side edges of second wall 24. Tab holders 34 are depicted attached to the uppermost of second barriers 20, but can also be attached to the lower second barrier 20. Tab holders 34 may be clipped or snapped on to second barriers 20. The upper portion of second wall 24 has second cutout 28 in it. Second divider 32 is arranged perpendicularly to both second shelf 16 and second wall 24. Second divider 32 extends between second barriers 20 and second cutout 28 and is slidably mounted on second wall 24 and the uppermost second barrier 20. In the current embodiment, second shelf 16 is about 7.75 inches wide and 9.5 inches long. In the current embodiment, medicine caddy 10 is made of plastic. The quantity and placement of first dividers 30 and second dividers 32 can be varied according to the user's preference. First dividers 30, second dividers 32, first barriers 18, and second barriers 20 serve to separate and hold medicine bottles (not shown) placed on first shelf 14 and second shelf 16. Tabs 34 identify the type of medicine bottle stored behind each tab 34.

Figure 2:
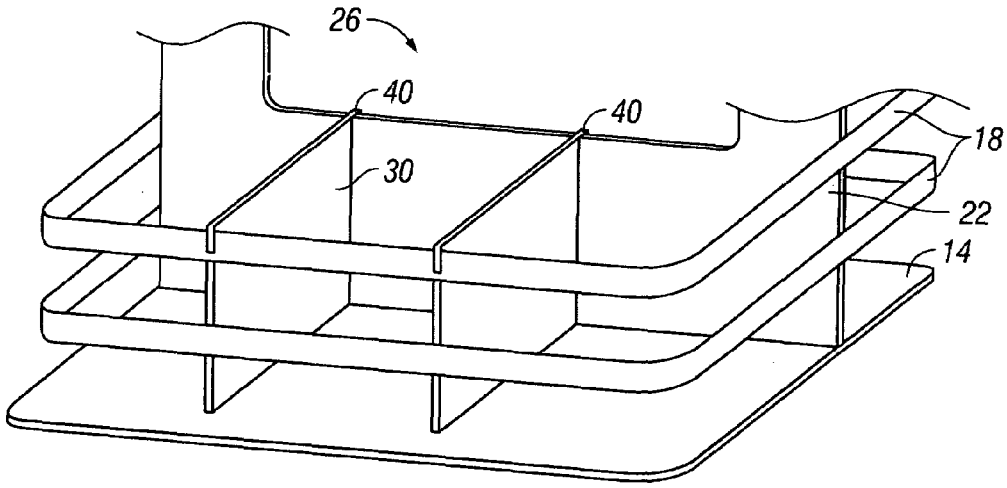
FIG. 2 is a top perspective fragmentary view of the bottom tier of the present invention.

Moving on to FIG. 2, a new and improved bottom tier 38 of the present invention for storing and organizing medicines is illustrated and will be described. More particularly, bottom tier 38 has first dividers 30 slidably connected by first divider wall hooks 40 to the portion of first wall 22 that defines the lower edge of first cutout 26. The opposing end of first dividers 30 is slidably mounted on the uppermost first barrier 18. Second divider 32 possesses a divider wall hook (not shown) as well that is similarly mounted on second wall 24 at second cutout 28.

Figure 3:
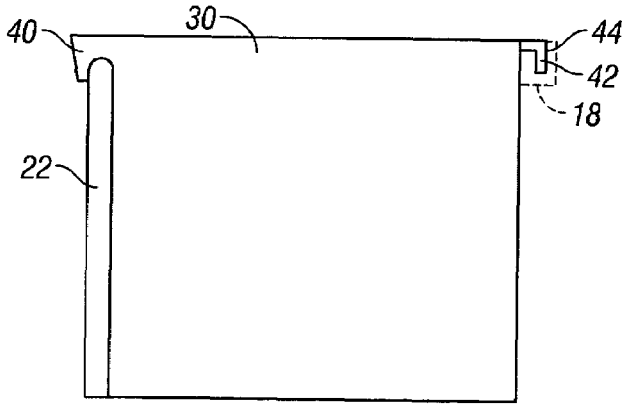
FIG. 3 is a side sectional view of the first divider of the present invention.

Continuing with FIG. 3, a new and improved first divider 30 of the present invention for storing and organizing medicines is illustrated and will be described. More particularly, first divider 30 has first divider wall hook 40 attached to one end of its top and first divider barrier hook 42 attached to the opposing end of its top. First divider wall hook 40 is slidably mounted on the portion of first wall 22 that defines the lower edge of first cutout 26 (not shown). First divider barrier hook 42 is slidably received by first barrier slot 44 in the uppermost first barrier 18. Second divider 32 possesses a divider barrier hook as well (not shown) and is similarly mounted in a barrier slot (not shown) in the uppermost second barrier 20.

Figure 4:
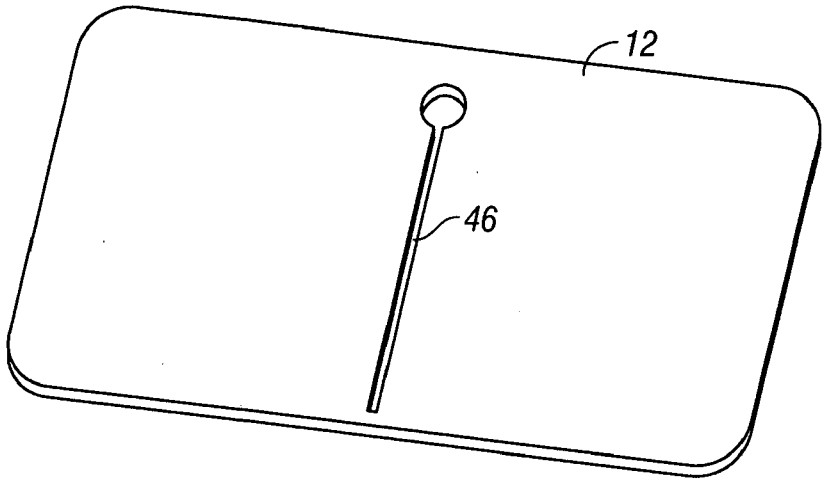
FIG. 4 is a top perspective view of the base of the present invention.

In FIG. 4, a new and improved base 12 of the present invention for storing and organizing medicines is illustrated and will be described. More particularly, the base 12 has base slot 46 in its middle. Base slot 46 allows first shelf 14 (not shown) to slide and/or rotate with respect to base 12. One end of base slot 46 is enlarged and circular to receive a guide pin (not shown) attached to the bottom of first shelf 14.

Figure 5:
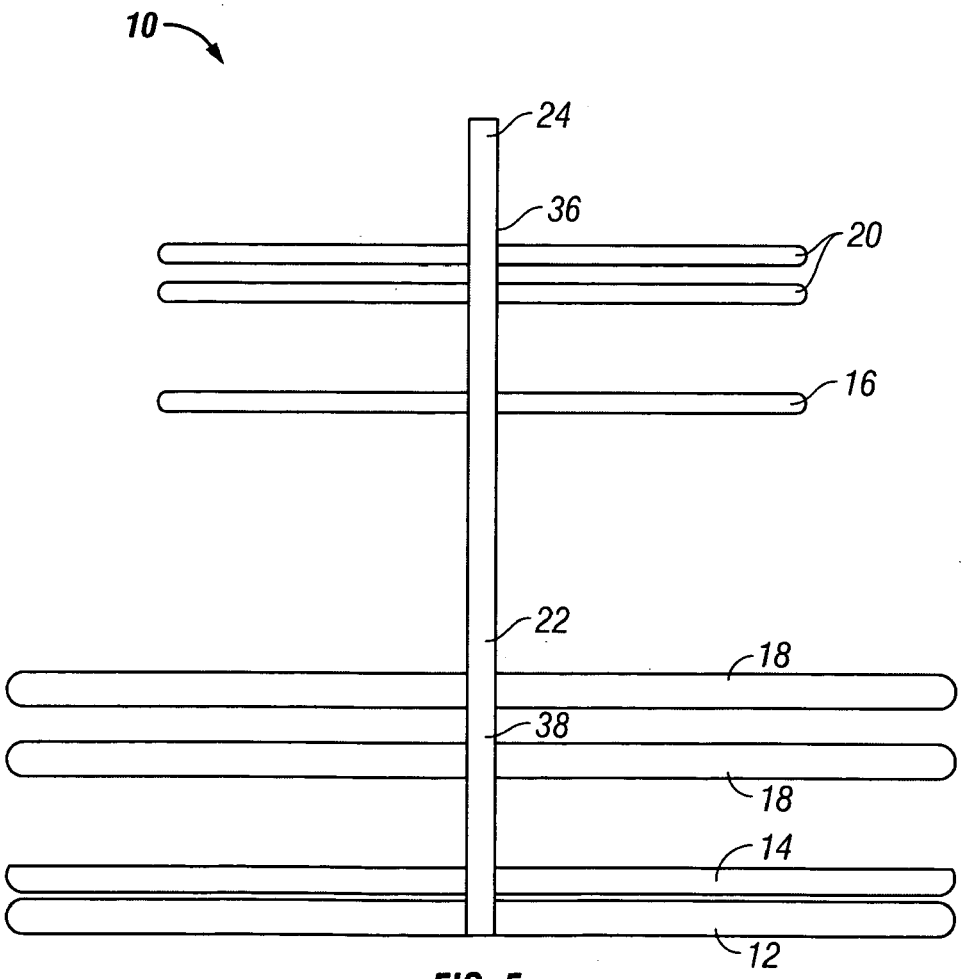
FIG. 5 is a side sectional view of the medicine caddy of the present invention.

Furthermore, in FIG. 5, a new and improved medicine caddy 10 of the present invention for storing and organizing medicines is illustrated and will be described. More particularly, the medicine caddy 10 has a base 12 onto which bottom tier 38 and top tier 36 are mounted vertically. First wall 22 extends perpendicularly from first shelf 14. Second wall 24 is attached to the top of first wall 22. Second shelf 16 is attached to the top of first wall 22. First barriers 18 are attached to the side edges of first wall 22, and second barriers 20 are attached to the side edges of second wall 24.

Figure 6:
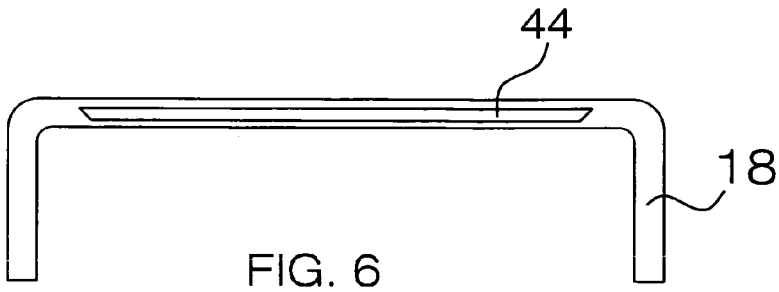
FIG. 6 is a top view of the first barrier of the present invention.

In FIG. 6, a new and improved first barrier 18 of the present invention for storing and organizing medicines is illustrated and will be described. More particularly, the uppermost first barrier 18 has first barrier slot 44 in one side. First barrier slot 44 receives first divider barrier hooks 42 (not shown). The uppermost second barrier 20 also has a barrier slot (not shown) in one side.

Figure 7:
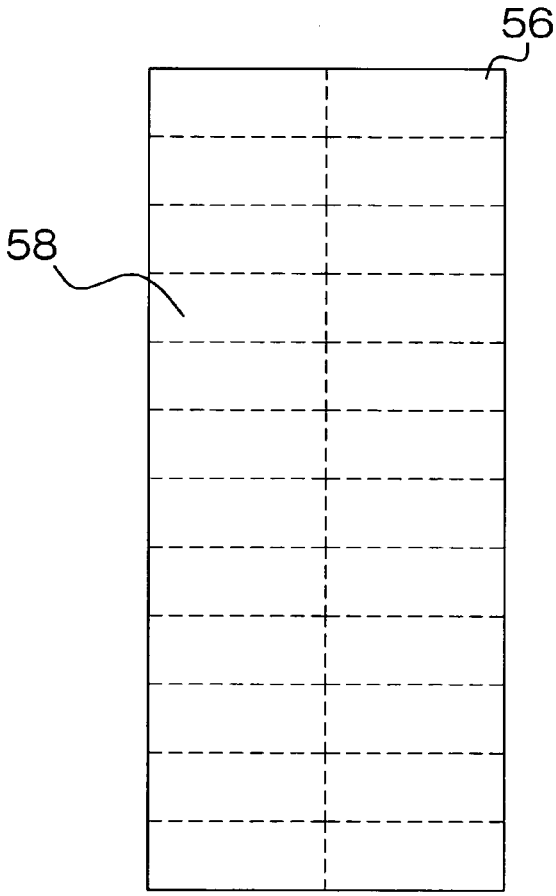
FIG. 7 is a side view of the tabs of the present invention.
Figure 7A:
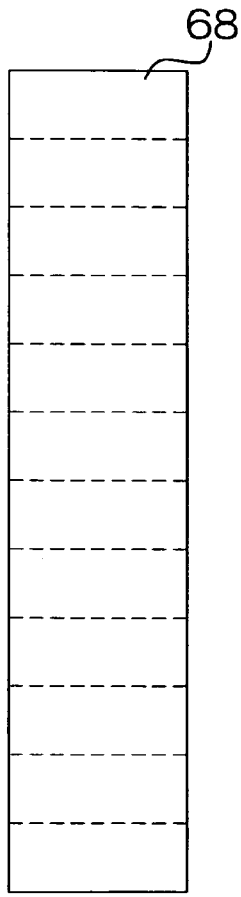

In FIG. 7, new and improved tabs 68 of the present invention for storing and organizing medicines is illustrated and will be described. More particularly, tabs 68 are arranged in perforated sheet 56 with perforations 58 prior to being separated and removably inserted into tab holders 34. In the current embodiment, tabs 68 are colored red, blue, yellow, and green. Tabs 68 are translucent in the current embodiment.

Figure 8:
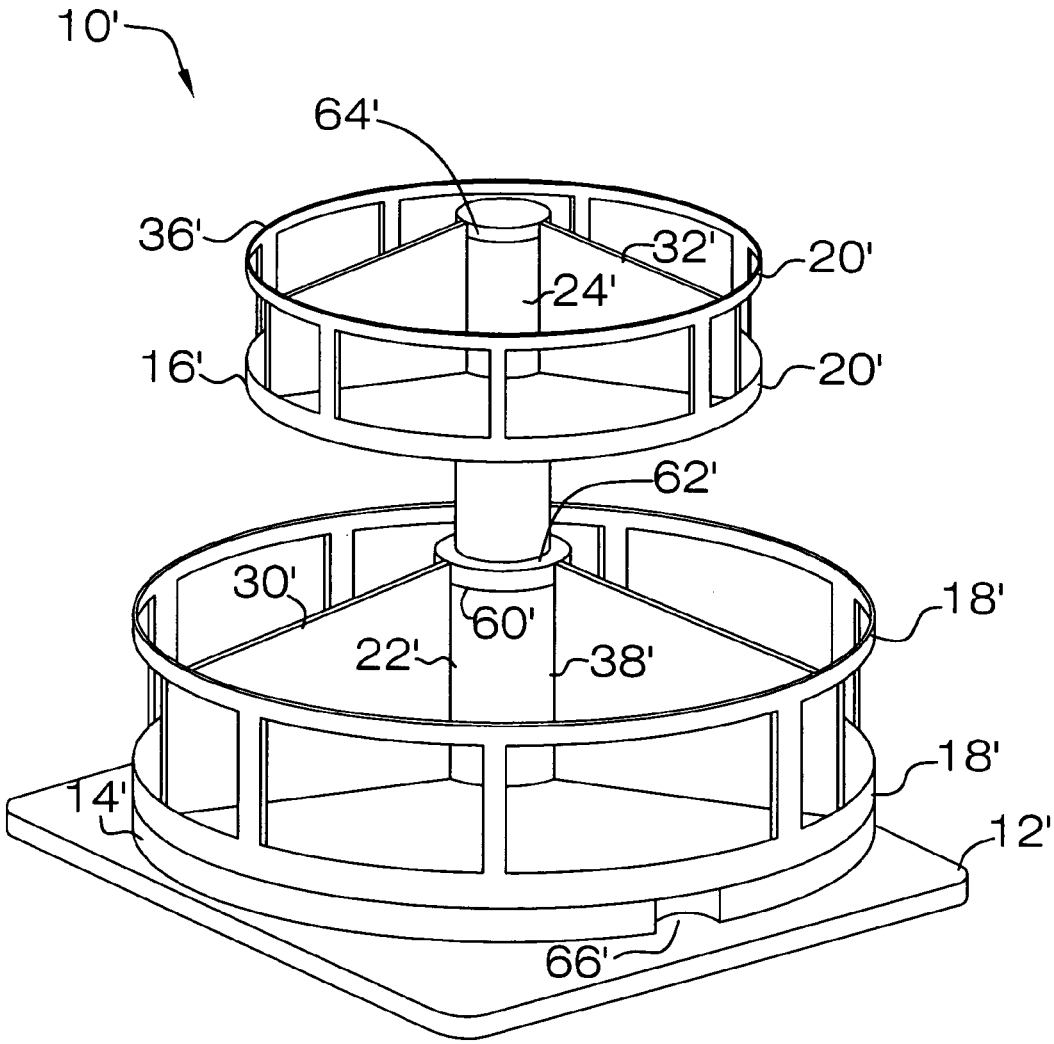
FIG. 8 is a top perspective view of an alternative embodiment of the medicine caddy constructed in accordance with the principles of the present invention.

Concluding with FIG. 8, an alternative embodiment of the new and improved medicine caddy 10 of the present invention for storing and organizing medicines is illustrated and will be described. More particularly, the medicine caddy 10 has base 12 onto which bottom tier 38 and top tier 36 are rotatably mounted. Rotation joint 60 permits top tier 36 to rotate independently of bottom tier 38. Bottom tier 38 consists of first wall 22, first barriers 18, and first dividers 30. First dividers 30 have one end slidably mounted within first wall slots 62 so that first dividers 30 can be adjusted to segment first shelf 14 as the user desires. Top tier 36 consists of second wall 24, second barriers 20, and second dividers 32. Second dividers 32 have one end slidably mounted within second wall slots 64 so that second dividers 32 can be adjusted to segment second shelf 16 as the user desires. First shelf thumb tab 66 aides the user in rotating first shelf 14 with respect to base 12. In the current embodiment, base 12 is generally square in shape, and first shelf 14 and second shelf 16 are round.

In use, it can now be understood that in the case of the first embodiment, the user installs and positions the desired quantity of first dividers 30 in bottom tier 38 and second dividers 32 in top tier 36. The user then installs the desired tab holders 34 on first barriers 18 and second barriers 20 where desired and, after separating the desired tabs 68 from one another, removably inserts tabs 68 in to tab holders 34 as needed to identify the medicine bottles placed between each divider. The user removes emergency contact card 50 and/or magnifying lens 52 from thumb tabs 54 in first wall 22 as needed.

The user can slide and/or rotate first shelf 14, and therefore the bottom tier 38 and top tier 36 with respect to base 12 as needed to facilitate access to medicine bottles stored on first shelf 14 and second shelf 16. In the case of the second embodiment, the user can position the first dividers 30 and second dividers 32 as desired. The user can also rotate top tier 36 and bottom tier 38 independently of one another and of base 12.

While a current embodiment of the medicine caddy has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable material such as steel, aluminum, titanium, glass, or carbon fiber composite may be used instead of the plastic described. Also, the colored tabs may be transparent. And although storing and organizing medicines has been described, it should be appreciated that the medicine caddy herein described is also suitable for storing a wide range of packaged items, including spices, hardware, or fishing lures.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A medicine caddy comprising:

a base having a top;

a first shelf having a top and a bottom with said bottom attached to said top of said base;

a first wall having opposing sides, opposing ends, and a middle with one end perpendicularly attached to said top of said first shelf;

a second wall having opposing sides, opposing ends, and a middle with one end attached to one of said opposing ends of said first wall;

a second shelf perpendicularly attached to one of said opposing ends of said second wall;

a first barrier having opposing sides and a top, wherein said first barrier has its opposing sides attached to said opposing sides of said first wall;

a second barrier having opposing sides and a top, wherein said second barrier has its opposing sides attached to said opposing sides of said second wall;

a first divider having a top and opposing sides, wherein one of said opposing sides of said first divider is removably and slidably connected to said first wall and one of said opposing sides of said first divider is removably and slidably connected to said first barrier; and a second divider having a top and opposing sides, wherein one of said opposing sides of said second divider is removably and slidably connected to said second wall and one of said opposing sides of said second divider is removably and slidably connected to said second barrier.

2. The medicine caddy as defined in claim 1, further comprising:

a first cutout, wherein said middle of said first wall defines a hole therein to comprise said first cutout;

a second cutout, wherein said middle of said second wall defines a hole therein to comprise said second cutout;

a first divider wall hook attached to one of said opposing sides of said top of said first divider;

a second divider wall hook attached to one of said opposing sides of said top of said second divider;

a first barrier slot, wherein said top of said first barrier defines a slot therein to comprise said first barrier slot;

a second barrier slot, wherein said top of said second barrier defines a slot therein to comprise said second barrier slot;

a first divider barrier hook attached to one of said opposing sides of said top of said first divider; and a second divider barrier hook attached to one of said opposing sides of said top of said second divider.

3. The medicine caddy as defined in claim 1, further comprising a tab holder removably attached to one of the said first barrier and said second barrier.

4. The medicine caddy as defined in claim 1, further comprising:

a thumb tab in one of said opposing sides of said first wall; and an emergency contact card slidably and removably inserted into said thumb tab.

5. The medicine caddy as defined in claim 1, further comprising:

a thumb tab in one of said opposing sides of said first wall; and a magnifying lens slidably and removably inserted into said thumb tab.

6. The medicine caddy as defined in claim 1, further comprising a base slot, wherein said top of said base defines a slot therein to comprise said base slot, thereby permitting said first shelf to slide and rotate with respect to said base.

7. The medicine caddy as defined in claim 3, wherein said tab holder is translucent or transparent.

8. The medicine caddy as defined in claim 1, further comprising a plurality of tabs joined by perforations into a perforated sheet.

9. The medicine caddy as defined in claim 8, wherein said tabs have a color selected from the group consisting of red, blue, yellow, and green.

10. The medicine caddy as defined in claim 1, wherein said base is about 11 inches long and 9 inches wide.

11. The medicine caddy as defined in claim 1, wherein said second shelf is about 9.5 inches long and 7.75 inches wide.

12. The medicine caddy as defined in claim 1, wherein said medicine caddy is made from a material selected from the group consisting of plastic, steel, aluminum, titanium, glass, and carbon fiber composite.

13. A medicine caddy comprising:

a base having a top;

a first shelf having a top and a bottom with said bottom attached to said top of said base;

a first wall having opposing sides, opposing ends, and a middle with one end perpendicularly attached to said top of said first shelf;

a second wall having opposing sides, opposing ends, and a middle with one end attached to one of said opposing ends of said first wall;

a second shelf perpendicularly attached to one of said opposing ends of said second wall;

a first barrier having opposing sides and a top, wherein said first barrier has its opposing sides attached to said opposing sides of said first wall;

a second barrier having opposing sides and a top, wherein said second barrier has its opposing sides attached to said opposing sides of said second wall;

a first divider having a top and opposing sides, wherein one of said opposing sides of said first divider is removably and slidably connected to said first wall and one of said opposing sides of said first divider is removably and slidably connected to said first barrier; and a second divider having a top and opposing sides, wherein one of said opposing sides of said second divider is removably and slidably connected to said second wall and one of said opposing sides of said second divider is removably and slidably connected to said second barrier;

a first cutout, wherein said middle of said first wall defines a hole therein to comprise said first cutout;

a second cutout, wherein said middle of said second wall defines a hole therein to comprise said second cutout;

a first divider wall hook attached to one of said opposing sides of said top of said first divider and removably inserted into said first cutout;

a second divider wall hook attached to one of said opposing sides of said top of said second divider and removably inserted into said second cutout;

a first barrier slot, wherein said top of said first barrier defines a slot therein to comprise said first barrier slot;

a second barrier slot, wherein said top of said second barrier defines a slot therein to comprise said second barrier slot;

a first divider barrier hook attached to one of said opposing sides of said top of said first divider and removably inserted into said first barrier slot; and a second divider barrier hook attached to one of said opposing sides of said top of said second divider and removably inserted into said second barrier slot.

14. The medicine caddy as defined in claim 13, further comprising:

a plurality of thumb tabs, one in each of said opposing sides of said first wall;

an emergency contact card slidably and removably inserted into one of said thumb tabs; and a magnifying lens slidably and removably inserted into one of said thumb tabs.

15. The medicine caddy as defined in claim 13, further comprising a plurality of tabs joined by perforations into a perforated sheet, wherein said tabs can be separated from one another and removably attached to said first barrier and/or said second barrier by being removably inserted into a plurality of tab holders attached to said first barrier and/or said second barrier.

* * * * *